US012752988B2

(12) United States Patent
Cooper et al.

(10) Patent No.: US 12,752,988 B2
(45) Date of Patent: Oct. 6, 2026

(54) IN-LINE CABLE BUNDLING SYSTEM

(71) Applicant: ABB Schweiz AG, Baden (CH)

(72) Inventors: Anthony Austin Cooper, Memphis, TN (US); Henry Joseph Stefanov, Germantown, TN (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 18/332,425

(22) Filed: Jun. 9, 2023

(65) Prior Publication Data

US 2024/0409286 A1 Dec. 12, 2024

(51) Int. Cl.
*B65D 63/10* (2006.01)

(52) U.S. Cl.
CPC ..... *B65D 63/1063* (2013.01)

(58) Field of Classification Search
CPC ..... B65D 63/1063
See application file for complete search history.

(56) References Cited

U.S. PATENT DOCUMENTS

| | | | | |
|---|---|---|---|---|
| 3,102,311 | A | 9/1963 | Martin et al. | |
| 3,257,694 | A * | 6/1966 | Litwin | A61B 90/05 D8/382 |
| 3,368,247 | A | 2/1968 | Orban | |
| 3,562,870 | A | 2/1971 | Sund | |
| 3,588,961 | A | 6/1971 | George | |
| 3,660,869 | A | 5/1972 | Caveney et al. | |
| 3,735,448 | A | 5/1973 | Waddington | |
| 3,875,618 | A | 4/1975 | Schiplin | |
| 3,906,593 | A | 9/1975 | Caveney et al. | |
| 3,908,233 | A | 9/1975 | Caveney et al. | |
| 3,949,449 | A | 4/1976 | Caveney et al. | |
| 3,965,538 | A | 6/1976 | Caveney et al. | |
| 3,973,293 | A | 8/1976 | Noorily | |
| 3,991,444 | A | 11/1976 | Bailey | |

(Continued)

FOREIGN PATENT DOCUMENTS

| | | |
|---|---|---|
| AU | 469885 B2 | 2/1976 |
| DE | 2342681 A1 | 3/1974 |

(Continued)

OTHER PUBLICATIONS

European Search Report for European Patent Application No. 23184214.7, dated Oct. 11, 2023, 14 pages.

(Continued)

*Primary Examiner* — David M Upchurch
(74) *Attorney, Agent, or Firm* — McCarter & English, LLP; Michael M. Gnibus

(57) ABSTRACT

An in-line object bundling system including a body and a strap is disclosed. The body has an insertion channel extending through the body, the channel including a first channel wall and a second channel wall opposite the first channel wall. At least one engagement member is disposed on the first channel wall. At least one biasing member is disposed on the second channel wall. The strap has a first strap surface and a second strap surface. The second strap surface includes strap engagement members. When the strap is inserted in the insertion channel the at least one biasing member contacts the first strap surface and thereby urges the strap engagement members proximate the at least one engagement member on the first channel wall.

20 Claims, 11 Drawing Sheets

(56) References Cited

U.S. PATENT DOCUMENTS

| | | | | | |
|---|---|---|---|---|---|
| 4,272,047 | A | | 6/1981 | Botka | |
| 4,272,870 | A | | 6/1981 | McCormick | |
| 4,287,644 | A | | 9/1981 | Durand | |
| 4,507,828 | A | | 4/1985 | Furutsu | |
| 4,631,782 | A | | 12/1986 | Gecs | |
| 4,658,478 | A | * | 4/1987 | Paradis | F16L 3/233 24/17 AP |
| 4,680,834 | A | * | 7/1987 | Andre | F16L 3/2336 24/17 AP |
| 4,688,302 | A | | 8/1987 | Caveney et al. | |
| 4,776,067 | A | | 10/1988 | Sorensen | |
| 4,866,816 | A | | 9/1989 | Caveney | |
| 4,993,669 | A | | 2/1991 | Dyer | |
| 5,102,075 | A | | 4/1992 | Dyer | |
| 5,146,654 | A | * | 9/1992 | Caveney | B29C 45/0053 24/17 AP |
| 5,193,251 | A | | 3/1993 | Fortsch | |
| 5,224,244 | A | * | 7/1993 | Ikeda | F16L 3/233 24/17 AP |
| 5,317,787 | A | | 6/1994 | Fortsch | |
| 5,389,330 | A | * | 2/1995 | Sorensen | F16L 3/2336 24/17 AP |
| 5,440,786 | A | * | 8/1995 | Sorensen | B65D 63/1081 24/17 AP |
| 5,452,523 | A | * | 9/1995 | Jansen | B65D 63/00 24/23 R |
| 5,513,421 | A | | 5/1996 | Wells | |
| 5,517,727 | A | | 5/1996 | Bernard et al. | |
| 5,621,949 | A | | 4/1997 | Wells et al. | |
| 5,642,554 | A | * | 7/1997 | Sorensen | B65D 63/1072 24/17 AP |
| 5,664,294 | A | * | 9/1997 | Sorensen | B65D 63/1081 24/17 AP |
| 5,745,957 | A | | 5/1998 | Khokhar et al. | |
| 5,890,265 | A | | 4/1999 | Christian et al. | |
| 5,911,367 | A | | 6/1999 | McInerney | |
| 5,911,368 | A | * | 6/1999 | Davignon | B65D 63/1081 24/17 AP |
| 5,924,171 | A | * | 7/1999 | Sorensen | F16L 3/2336 24/17 AP |
| 6,003,208 | A | | 12/1999 | Christian et al. | |
| 6,044,524 | A | * | 4/2000 | Sorensen | B65D 63/1081 24/17 AP |
| 6,128,809 | A | | 10/2000 | Khokhar | |
| 6,279,203 | B1 | | 8/2001 | Hundley et al. | |
| 6,347,434 | B1 | * | 2/2002 | Newman | B65D 63/1063 24/30.5 P |
| 6,473,942 | B1 | | 11/2002 | Caveney et al. | |
| 6,484,367 | B1 | | 11/2002 | Caveney et al. | |
| 6,526,628 | B1 | | 3/2003 | Caveney | |
| 6,530,126 | B2 | | 3/2003 | Caveney et al. | |
| 6,532,631 | B2 | | 3/2003 | Rohaly et al. | |
| 6,763,553 | B2 | | 7/2004 | Hatch | |
| 6,928,701 | B2 | | 8/2005 | Hutter, III | |
| 7,017,237 | B2 | | 3/2006 | Magno et al. | |
| 7,127,779 | B2 | * | 10/2006 | Hewes | B65D 63/1072 24/17 AP |
| 7,730,592 | B2 | * | 6/2010 | Krisel | B65D 63/1081 24/16 PB |
| 7,779,515 | B2 | | 8/2010 | DeMik et al. | |
| 7,819,365 | B2 | | 10/2010 | Elsner | |
| 8,407,863 | B2 | * | 4/2013 | Cheng | B65D 63/1072 24/16 PB |
| 8,516,660 | B2 | | 8/2013 | Ku | |
| 8,578,565 | B2 | | 11/2013 | Hienekamp | |
| 8,590,112 | B2 | | 11/2013 | Nelson et al. | |
| 9,061,807 | B2 | | 6/2015 | Drane et al. | |
| 9,828,152 | B2 | | 11/2017 | Dinh | |
| 10,029,835 | B1 | | 7/2018 | Cuddy et al. | |
| 10,144,566 | B2 | | 12/2018 | O'Regan et al. | |
| 10,480,688 | B2 | | 11/2019 | Tschida et al. | |
| 12,365,524 | B2 | | 7/2025 | Cooper et al. | |
| 2011/0271492 | A1 | | 11/2011 | Posner | |
| 2012/0272485 | A1 | * | 11/2012 | Liang | B65D 63/1063 24/16 PB |
| 2013/0081232 | A1 | | 4/2013 | Magno, Jr. et al. | |
| 2018/0135780 | A1 | * | 5/2018 | Tschida | B65D 63/1045 |
| 2018/0282037 | A1 | | 10/2018 | Zant et al. | |
| 2019/0009959 | A1 | | 1/2019 | Dinh et al. | |
| 2024/0010403 | A1 | | 1/2024 | Cooper et al. | |

FOREIGN PATENT DOCUMENTS

| | | | |
|---|---|---|---|
| EP | 0035368 | A1 | 9/1981 |
| EP | 1561702 | A1 | 8/2005 |
| EP | 2646338 | A1 | 10/2013 |
| WO | 2012/075034 | A1 | 6/2012 |
| WO | 2017/123869 | A1 | 7/2017 |
| WO | 2020181325 | A1 | 9/2020 |

OTHER PUBLICATIONS

Non Final Office Action, U.S. Appl. No. 17/859,478, filed Jul. 7, 2022, 9 pages.

U.S. Appl. No. 17/859,478, filed Jul. 7, 2022, 2024-0010403, Published.

Abb, Ty-Rap, Fastening solutions, Easily bundle, secure and manage your cables. Catalog. 170 pages, (2019).

Canadian Office Action for Application No. 3,205,793, dated Aug. 15, 2024, 4 pages.

European Office Action for Application No. 23184214.7, dated Nov. 11, 2023, 14 pages.

European Office Action for Application No. 24176449.7, dated Oct. 8, 2024, 10 pages.

European Office Action for Application No. 23184214.7, dated Jun. 12, 2025, 6 pages.

Canadian Office Action for Application No. 3,240,828, dated Nov. 28, 2025, 11 pages.

Canadian Office Action for Application No. 3,205,793, dated Jun. 1, 2026, 6 pages.

* cited by examiner

IN-LINE CABLE BUNDLING SYSTEM

BACKGROUND

The field of the disclosure relates generally to cable bundling systems and, more particularly, to low profile in-line cable bundling systems.

Cable bundling systems are used to collect or combine a plurality of cables that are strung in a ceiling, or other suitable suspension location in a building or factory for example. The bundling or locking system may comprise a strap that is adapted to be wrapped around the cable bundle. The strap has a flexible, unitary body with an opening located along the strap.

In use, the strap is wrapped around the cables and one end of the strap is inserted through the opening, and pulled through the opening in a direction of insertion until the strap is positioned snugly against the collected cables. The strap includes outwardly directed locking members that impede loosening displacement of the strap end in a second direction, and as a result the locking members maintain the strap tightly against the cables.

Over time, the locking members ability to effectively impede the loosening displacement may be reduced due to normal wear and tear, and therefore there is a need for a cable bundling system that maintains the support of the cable bundle over time.

BRIEF DESCRIPTION

In one aspect, an in-line object bundling system is disclosed. The in-line object bundling system includes a body and a strap. The body has an insertion channel extending through the body, and the channel includes a first channel wall and a second channel wall opposite the first channel wall. At least one engagement member is disposed on the first channel wall. At least one biasing member is disposed on the second channel wall. The strap extends from the body, and the strap has a first strap surface and a second strap surface. The second strap surface comprises strap engagement members. The strap is adapted to be advanced through the insertion channel in a direction of insertion. When the strap is inserted in the insertion channel, the at least one biasing member contacts the first strap surface and thereby urges the strap engagement members proximate the at least one engagement member on the first channel wall. The second strap surface is parallel to one of the first channel wall and the second channel wall.

BRIEF DESCRIPTION OF THE DRAWINGS

The reference symbols used in the drawings, and their meanings, are listed in summary form in the list of reference symbols. In principle, identical parts are provided with the same reference symbols in the figures.

DETAILED DESCRIPTION

In the following specification and the claims, reference will be made to a number of terms, which shall be defined to have the following meanings.

As used herein, the singular forms "a," "an," and "the" include plural references unless the context clearly dictates otherwise. The terms "comprising," "including," and "having" are intended to be inclusive and mean that there may be additional elements other than the listed elements. The terms "optional" or "optionally" means that the subsequently described event or circumstance may or may not occur, and that the description includes instances where the event occurs and instances where it does not.

As used herein, the spatial terms "upper," "lower," "top" and "bottom" as used in the present disclosure shall denote a component, or an element of a component, which is upstream or downstream relative to other components and elements of components unless the context clearly dictates otherwise. The term "upper" or "top" shall denote a downstream component or element of a component, and the term "lower" or "bottom" shall denote an upstream component or element of a component. Where a component has a top surface and a bottom surface, the top surface is parallel to the bottom surface. Such relative spatial terms are used only to facilitate description and are not meant to be limiting.

Embodiments of the present disclosure are directed an in-line object bundling system. The in-line object bundling system includes a body and a strap. The body has an insertion channel extending through the body, and the channel includes a first channel wall and a second channel wall opposite the first channel wall. At least one engagement member is disposed on the first channel wall. At least one biasing member is disposed on the second channel wall. The strap extends from the body, and the strap has a first strap surface and a second strap surface. The second strap surface comprises strap engagement members. The strap is adapted to be advanced through the insertion channel in a direction of insertion. When the strap is inserted in the insertion channel, the at least one biasing member contacts the first strap surface and thereby urges the strap engagement members proximate the at least one engagement member on the first channel wall. The second strap surface is parallel to one of the first channel wall and the second channel wall.

Figure 1:
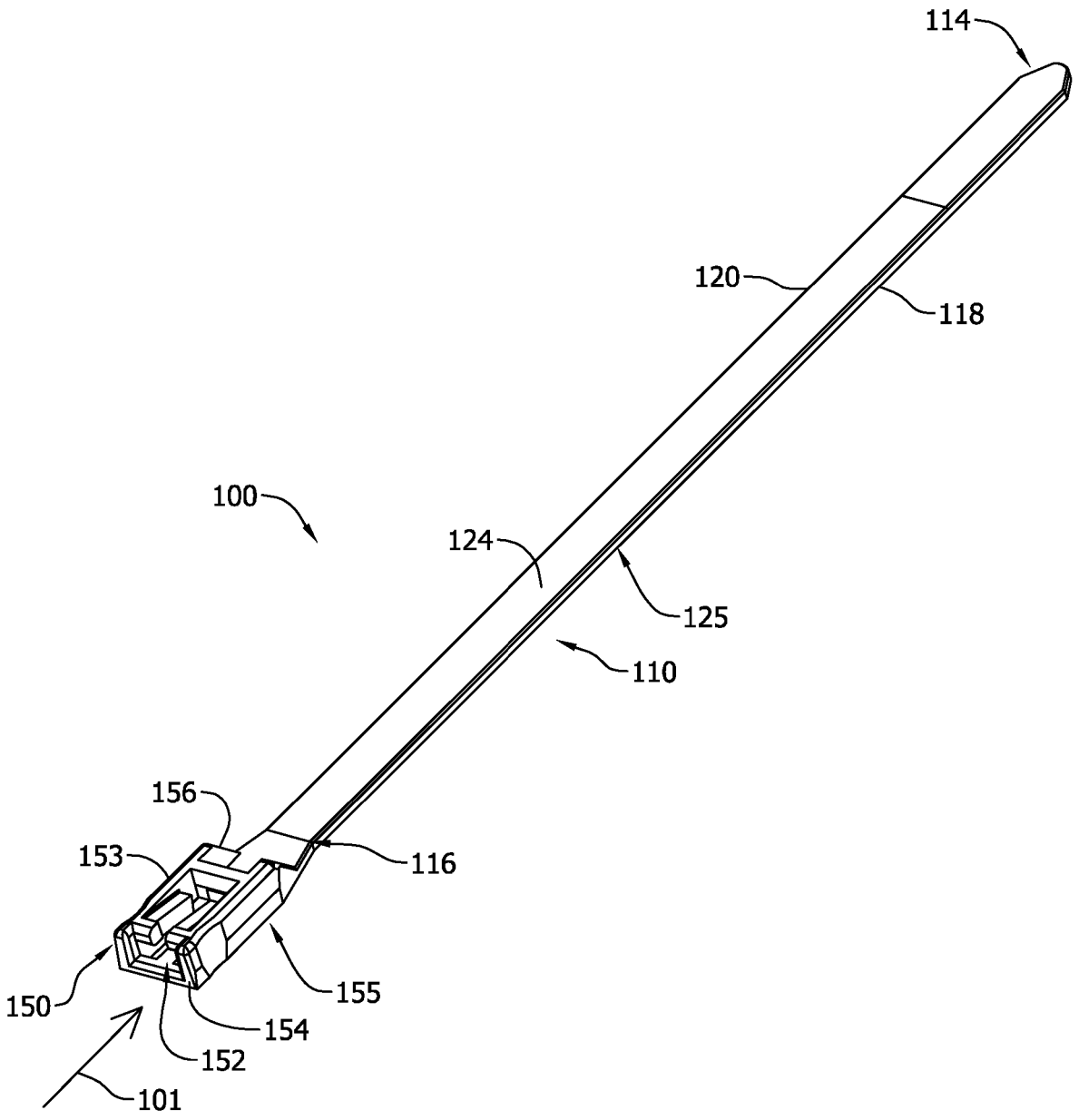
FIG. 1 illustrates a perspective view of an in-line cable bundling system in accordance with an embodiment of the present disclosure.

FIG. 1 illustrates a perspective top view of an in-line cable bundling system 100. As shown, the in-line cable bundling system 100 includes a strap 110 and a body 150. The strap 110 includes a first free end 114, a second end 116 made integral with the body 150, and a first edge 118 and a second edge 120 where the edges 118, 120 extend between ends 114 and 116. In the illustrated embodiments, the second end 116 of the strap 110 is made integral with the body 150 at the second end 116, thereby forming an in-line cable bunding system 100 that generally comprises the strap 110 and body 150. In some embodiments, the strap 110 and body 150 are non-unitary discrete members. In some embodiments, the strap 110 and the body 150 are comprised of a material selected from a group consisting of polymer, nylon, polyamide, heat stabilized nylon, and UV stabilized nylon. In some embodiments, the plurality of engagement members of the body are comprised of a metallic material or stainless steel.

Figure 2:
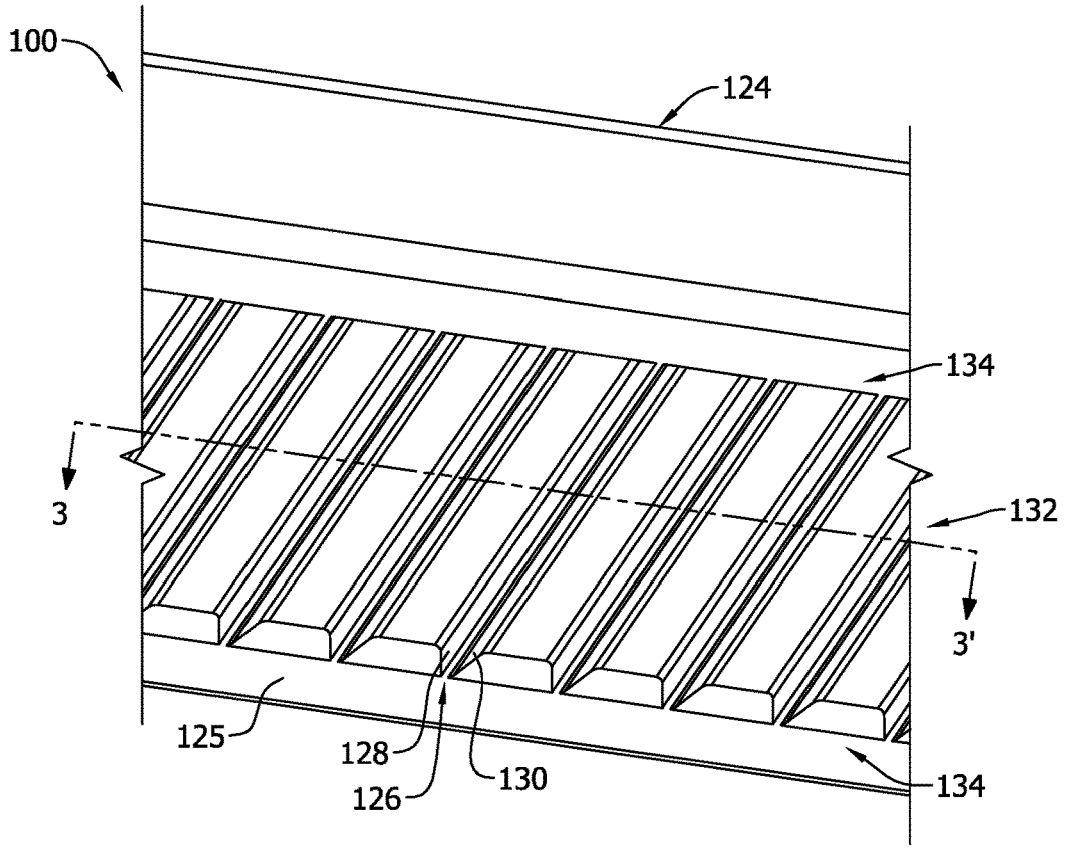
FIG. 2 illustrates a detailed view of DETAIL A of the strap as shown in FIG. 1.
Figure 3:
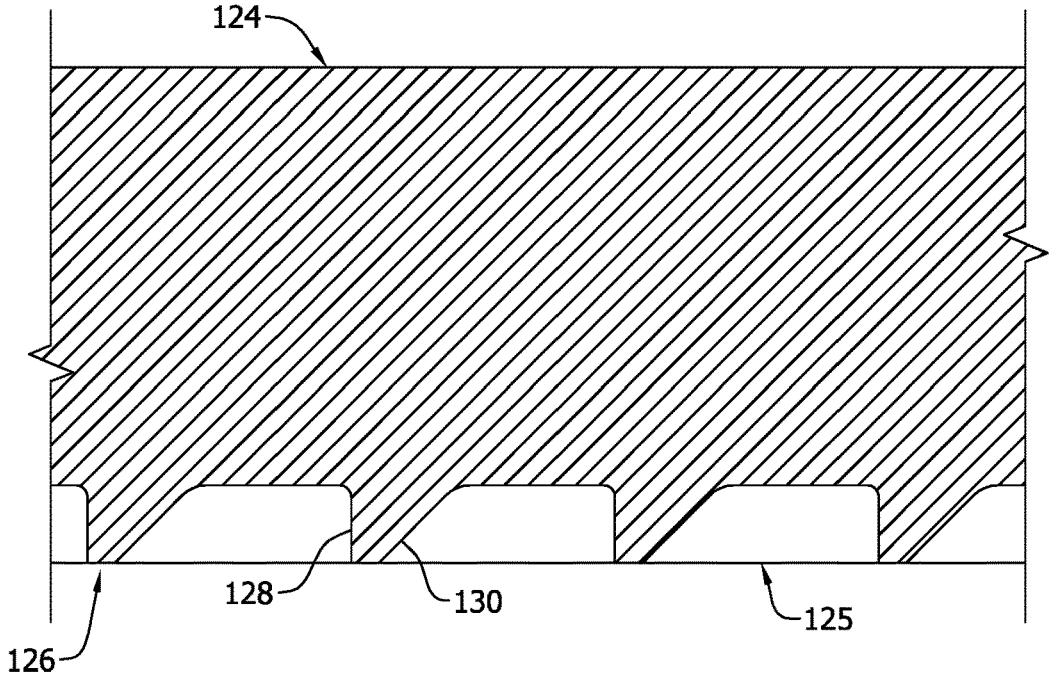
FIG. 3 illustrates a cross-sectional view of the strap along line 3-3' as shown in FIG. 2.
Figure 4:
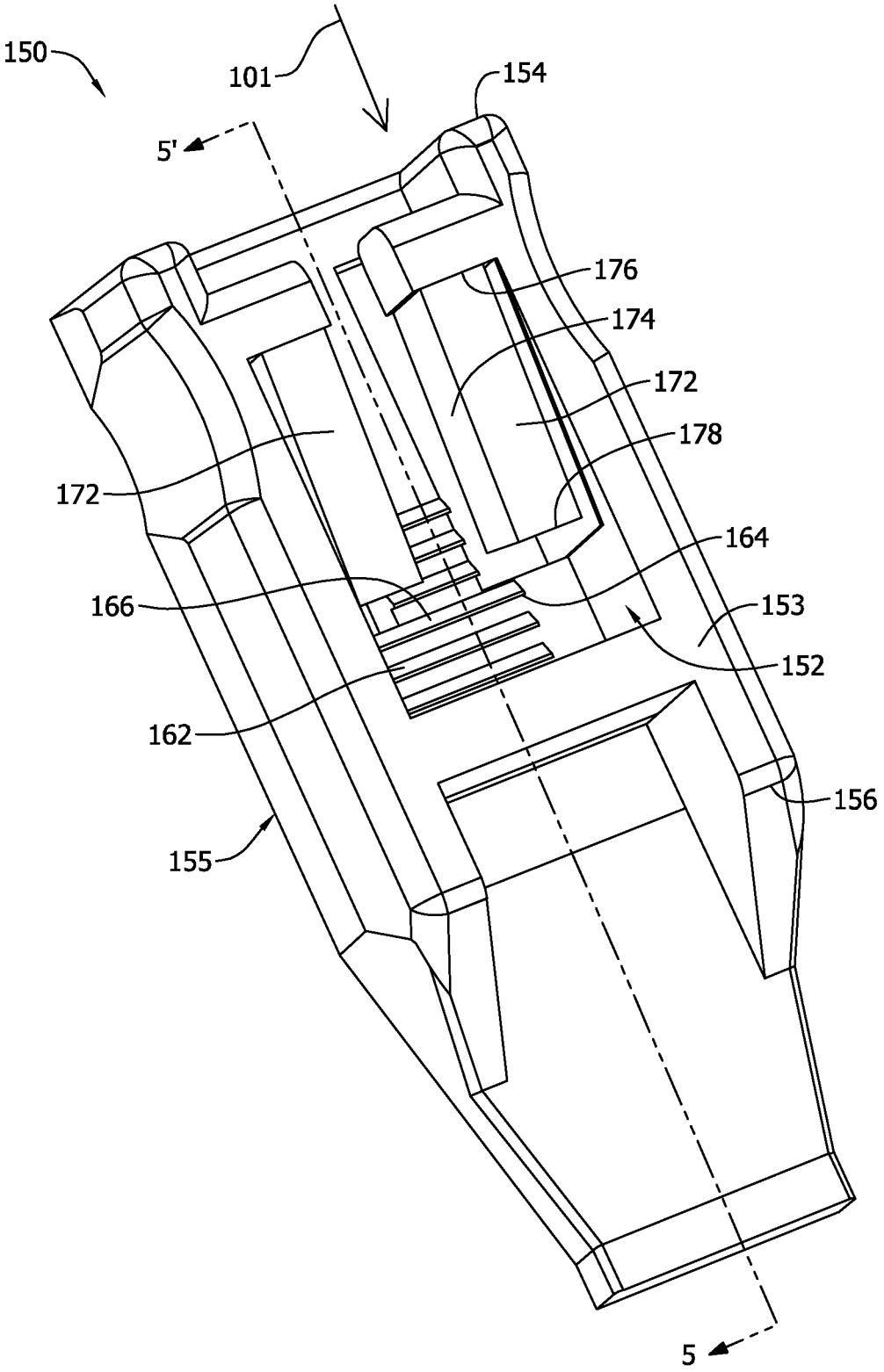
FIG. 4 illustrates a perspective view of the body of FIG. 1.

FIG. 2 illustrates a detailed view of DETAIL A of the strap 110 as shown in FIG. 1. FIG. 3 illustrates a cross-sectional view of the strap 110 along line 3-3' as shown in FIG. 2. In some embodiments, a bottom surface 125 of the strap 110 includes a plurality of strap engagement members 126 defining a medial portion of the strap 110. Lateral portions 134 on either side of the medial portion 132 define sidewalls of the strap 110. In some embodiments, the medial portion 132 is recessed relative to the lateral portions 134. As explained in further detail below, the plurality of strap engagement members 126 are configured to interlock with at least one body engagement member 162 (as shown in FIG. 4) as the first end 114 is advanced through the body 150 in a direction of insertion (indicated by arrows 101 in FIG. 1). In some embodiments, the plurality of strap engagement members 126 are barbed teeth that each interlock with at least one body engagement member 162 (as shown in FIG. 4).

In some embodiments, the plurality of strap engagement members 126 include a holding edge 128 and a leading edge 130. In some embodiments, the holding edge 128 is substantially perpendicular relative to the bottom surface 125 of the strap 110 and the leading edge 130 is oriented at an angle relative to the substantially planar bottom surface 125 of the strap 110. The leading edge 130 is directed towards and facing the first free end 114 of the strap 110 (as shown in FIG. 1) and the holding edge 128 is directed towards and facing the second end 116. In some embodiments, the engagement members are configured as a ratcheting mechanism, where the plurality of strap engagement members 126 are advanceable in the direction of insertion 101, but are prevented from advancing in the opposite direction by the interference contact between at least one of the strap engagement members 126 and at least one body engagement member 162 (as shown in FIG. 4).

Figure 5:
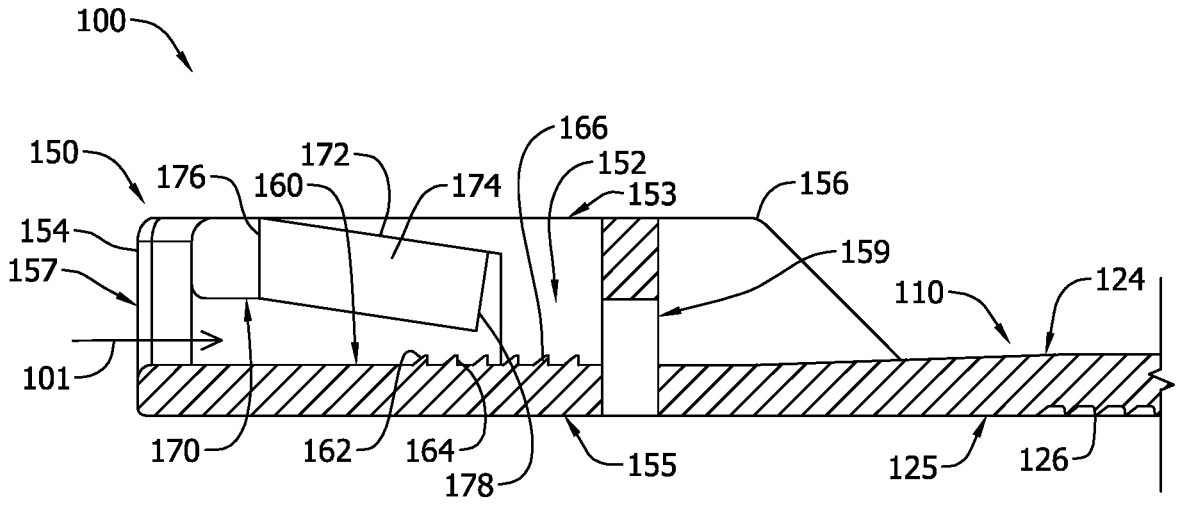
FIG. 5 illustrates a cross-sectional view of the body of FIG. 4 taken along line 5-5' in FIG. 4.
Figure 6:
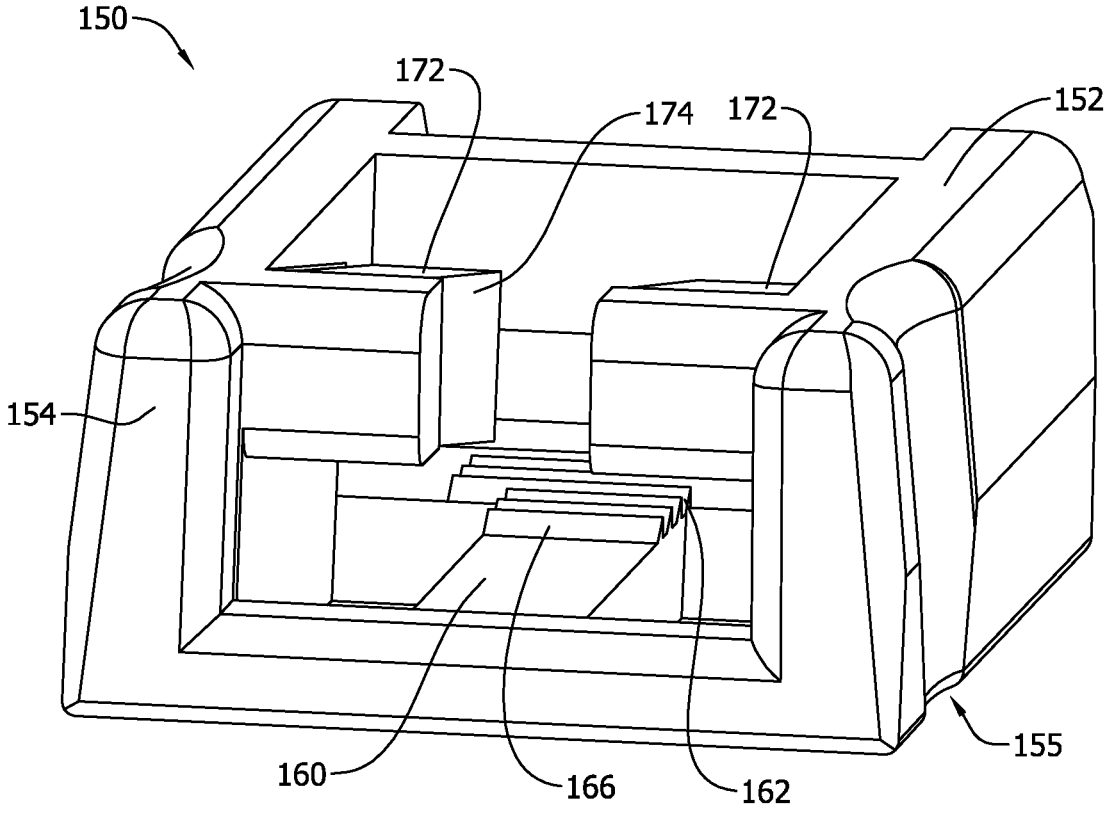
FIG. 6 illustrates a perspective view of the body of FIG. 1.
Figure 7:
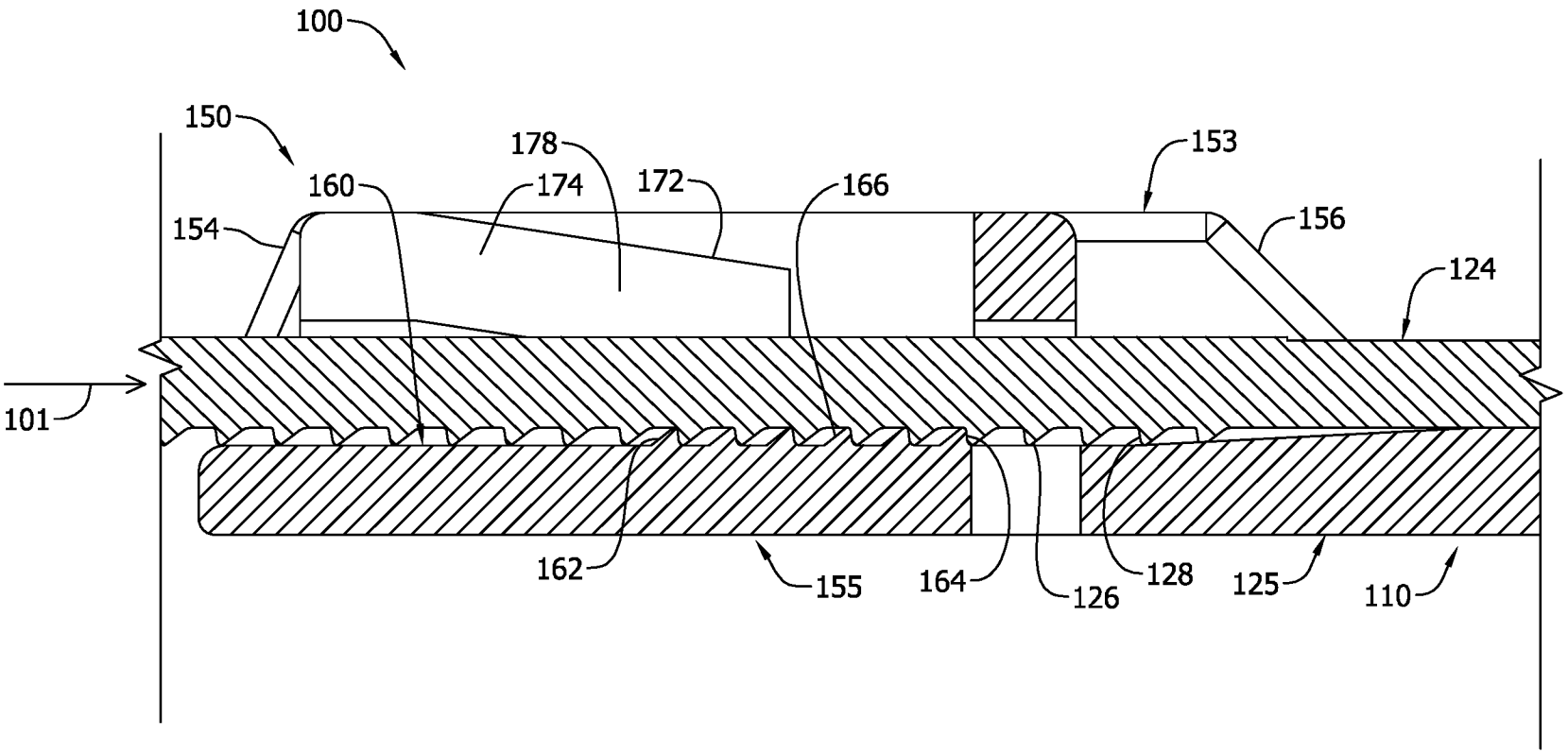
FIG. 7 illustrates a cross-sectional view of the strap inserted within the insertion channel of the body.

FIG. 4 illustrates a perspective view of the body 150 and FIG. 5 illustrates a cross-sectional view of the body 150 taken along line 5-5' as shown in FIG. 4. FIG. 7 illustrates a cross-sectional view of the strap 110 inserted within the insertion channel 152 of the body 150. With reference to FIGS. 1, and 4-7, the body 150 includes a first end 154 having an opening 157 and a second end 156 having an opening 159 opposite the first end 154. The body 150 further includes a top surface 153 and a bottom surface 155 opposite the top surface 153. The top and bottom surfaces extend between the body ends. In some embodiments, the top surface 153 of the body 150 and the top surface 124 of the strap 110 define top surfaces of the in-line cable bundling system 100.

An insertion channel 152 extends through the body 150 from the opening 157 of the first end 154 to the opening 159 of the second end 156 of the body 150, and the strap 110 is adapted to be advanced through the insertion channel 152 from the first end 154 in the direction of insertion 101. In some embodiments, the strap 110 is integral to the body 150 such that the strap 110 can be looped around the body 150 and inserted from the first end 154 in the direction of insertion 101. The insertion channel 152 is defined by a first channel wall 160 and a second channel wall 170 opposite the first channel wall 160. In the illustrated embodiment, the first channel wall 160 is along the bottom surface 155 of the body 150 and the second channel wall 170 is along the top surface 153 of the body 150. The bottom surface 125 of the strap 110 is substantially parallel to one or both of the first channel wall 160 and the second channel wall 170 such that the strap 110 extends parallel to the body 150.

At least one body engagement member 162 is disposed on the first channel wall 160. In the illustrated embodiments, the first channel wall 160 and the body engagement member 162 are coplanar to the strap 110. See FIG. 5. In some embodiments, the least one body engagement member 162 are barbed teeth that each interlock with the at least one engagement member 126. In some embodiments, the at least one body engagement member 162 includes a holding edge 164 and a leading edge 166. In some embodiments, the holding edge 164 is substantially perpendicular relative to first channel wall 160 and the leading edge 166 is oriented at an angle relative to the first channel wall 160. The leading edge 166 is directed towards and facing the first end 154 of the body 150 and the Seeholding edge 164 is directed towards and facing the second end 156. As the first free end 114 of the strap 110 is inserted into the body 150, through opening at end 154, the leading edge 130 of the strap 110 first traverses the leading edge 166 of the body 150 and the holding edge 128 of the strap 110 interlocks with the holding edge 164 of the body 150. As best shown in FIG. 7, the holding edge 128 of the strap 110 engages the holding edge 164 of the body 150 upon advancement of the strap 110 in a direction opposite the direction of insertion 101 and after at least one holding edge 128 of the strap 110 traverses over the holding edge 164 of the body 150 in the direction of insertion 101. In the illustrated embodiment, the body 150 includes a plurality of engagement members 162 which form the ratcheting mechanism, however it is understood that a single body engagement member 162 may form the ratcheting mechanism together with the plurality of strap engagement members 126.

At least one biasing member 172 is disposed on the second channel wall 170 of the body 150. In some embodiments, the at least one biasing member 172 comprises a barbed flexure 174 having a first end 176 integral to the second channel wall 170 and a cantilevered second end 178 extending from the first end 176. The first end 176 is positioned within the insertion channel 152 and adjacent to the first end 154 of the body 150. The cantilevered second end 178 is located within the insertion channel 152 and extends from the first end 176 in the direction of insertion 101 towards the second end 156.

As best shown in FIG. 7, the barbed flexure 174 (and the biasing member 172 generally) is configured to apply a biasing force against the top surface 124 of the strap 110 as the strap 110 is inserted into the insertion channel 152. As a result of the contact by the biasing member 172 against the surface 124, the segment of the strap 110 in the insertion channel 152 is urged toward the bottom surface 155 such that the plurality of strap engagement members 126 are maintained in engagement with the at least one body engagement member 162 on the first channel wall 160 upon the strap 110 being advanced in the direction opposite the insertion direction 101.

In operation, the strap 110 is inserted through opening 157, into insertion channel and pulled outward from opening 159. The strap is advanced in the direction of insertion 101 until an object bounded by the strap 110 is cinched to a desired torque or holding force, or until the strap can no longer be advanced in the direction of insertion 101. Once the objects are suitably bounded, the strap 110 is advanced in the second direction opposite the direction of insertion 101 and as a result causes the holding edge 128 of the strap 110 to engage the holding edge 164 of the body 150, preventing the strap 110 from further advancing in the opposite direction, and non-removably locking the strap 110 to the body 150 and defining a locked state where loosening displacement of the strap 110 is impeded. The engagement between the strap and body engagement members is shown in FIG. 7. In order to loosen the system 100 from the bounded objects, the strap 100 may be cut or the integrity of the tie is otherwise degraded."

Figure 8:
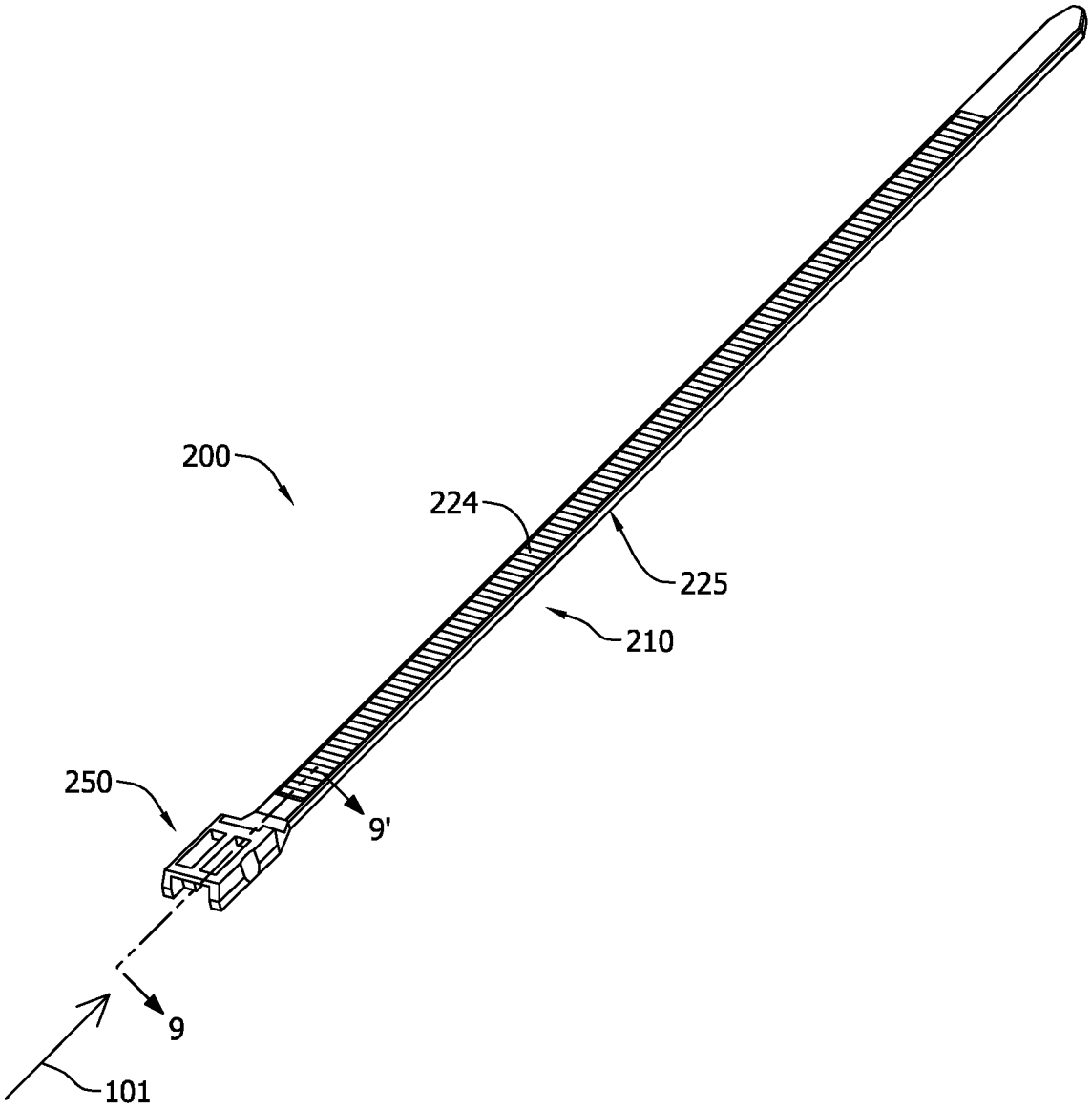
FIG. 8 is a perspective view of an in-line cable bundling system in accordance with a second embodiment of the present disclosure.
Figure 9:
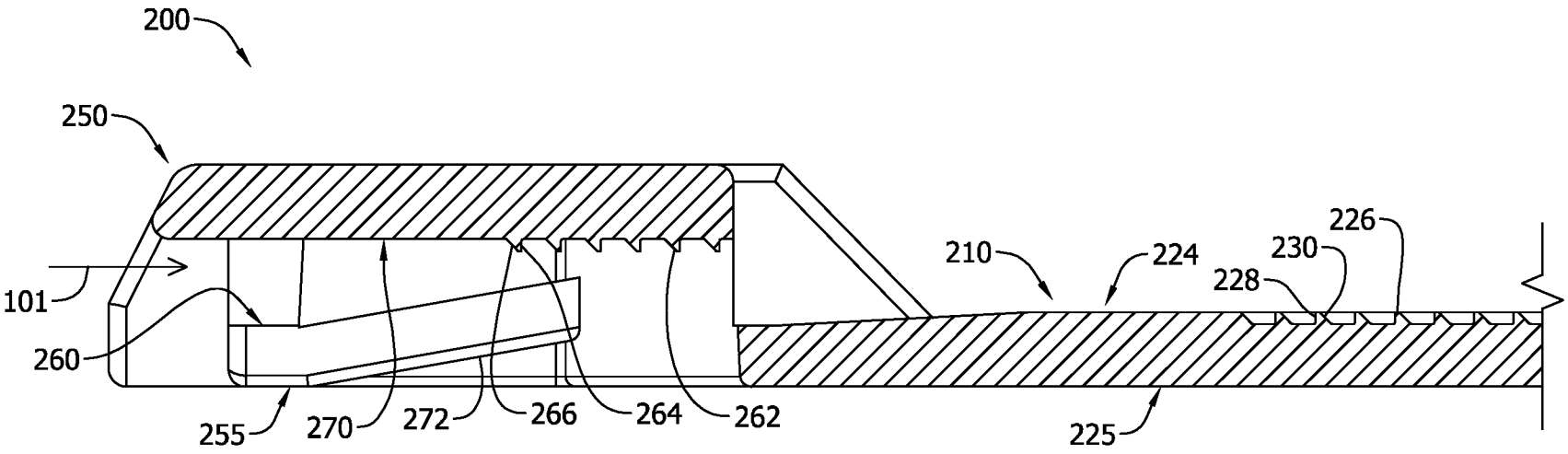
FIG. 9 is a cross-sectional view of the in-line cable bundling system of FIG. 8 taken along line 9-9'.

FIGS. 8 and 9 illustrate an in-line cable bundling system 200 in accordance with another embodiment of the present disclosure. FIG. 8 is a perspective top view of the in-line cable bundling system 200 and FIG. 9 is a cross-sectional view of the in-line cable bundling system 200 taken along line 9-9' in FIG. 8. The in-line cable bundling system 200 of FIGS. 8 and 9 operates in substantially the same manner as the previously described in-line cable bundling system 100 of FIGS. 1-7. The in-line cable bundling system 200 includes a strap 210 that is made integral with a body 250. The strap 210 comprises a plurality of strap engagement members 226, and the strap 210 and plurality of strap engagement members 226 are similar to the strap 110 and strap engagement members 126 of the first embodiment of the disclosure disclosed in FIGS. 1-7. Contrasting in-line cable bundling systems 100 and 200, strap engagement members 126 are located along the bottom surface 125 of the strap 110, and in bundling system 200, the strap engagement members 226 are located along top surface 224 of the strap 210. The body 250 includes at least one body engagement member 262 and at least one biasing member 272. Body 250, engagement member 262 and at least one biasing member 272 are similar to the respective body 150, body engagement member 162, and biasing member 172 of the first embodiment of the disclosure previously described and shown in FIGS. 1-7. As will be described below, the strap and body engagement members engage to produce a ratchet-type mechanism to impeded movement of the strap in a direction opposite insertion direction 101 and the biasing member 272 urges the strap section toward the body, further impeding undesired strap displacement.

The first channel wall 260 and the second channel wall 270 of the body 250 have the same orientation as the first channel wall 160 and the second channel wall 170 of the body 150 of FIGS. 1-7. Similar to the in-line cable bundling system 100 of FIGS. 1-7, the bottom surface 225 of the strap 210 is parallel to one of the first channel wall 260 and the second channel wall 270 such that the strap 210 extends parallel to the body 250.

The plurality of strap engagement members 226 are disposed on a top surface 224 of the strap 210. The at least one body engagement member 262 is disposed on a second channel wall 270 of the body 250 and the at least one biasing member 272 is disposed on a first channel wall 260 of the body 250. Unlike the cable budling system 100 where the first channel wall 160 and the body engagement member 162 are planar to the strap 110 when the strap is not in use, the body 250 and the strap 210 of the second alternate embodiment in-line cable tie system are not substantially coplanar, the strap 210 is coplanar with the at least one biasing member 272 disposed on the first channel wall 260 of the body 250.

The plurality of strap engagement members 226 include a holding edge 228 and a leading edge 230 similar to the holding edge 128 and a leading edge 130 of the strap 110 of the in-line cable bundling system 100 of FIGS. 1-7. Likewise, the at least one body engagement member 262 has a holding edge 264 and a leading edge 266 that are configured similar to the holding edge 164 and a leading edge 166 of the body 150 of the in-line cable bundling system 100 of FIGS. 1-7 and function to produce the ratchet mechanism previously described. The free end of the at least one biasing member 272 is located proximate the at least one body engagement member 262.

In operation, the strap 210 is advanced in the direction of insertion 101 through the openings provided in the body as previously described until an object bounded by the strap 210 is cinched to a desired torque or holding force, or until the strap can no longer be advanced in the direction of insertion 101. Subsequently advancing the strap 210 in the second direction opposite the direction of insertion 101 causes the at least one strap engagement members 226 to engage the at least one body engagement member 262, preventing the strap 210 from further advancing in the opposite direction, and non-removably locking the strap 210 to the body 250 and defining a locked state where loosening displacement of the strap 210 is impeded.

Figure 10:
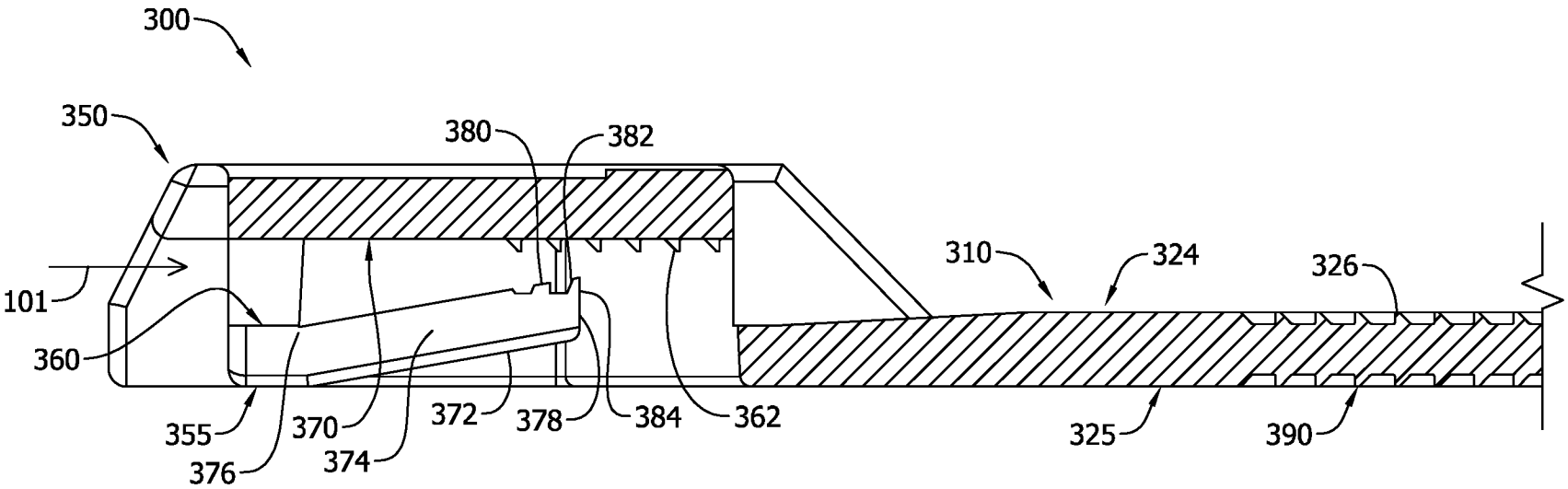
FIG. 10 illustrates cross-sectional view of an in-line cable bundling system in accordance with a third embodiment of the present disclosure.
Figure 11:
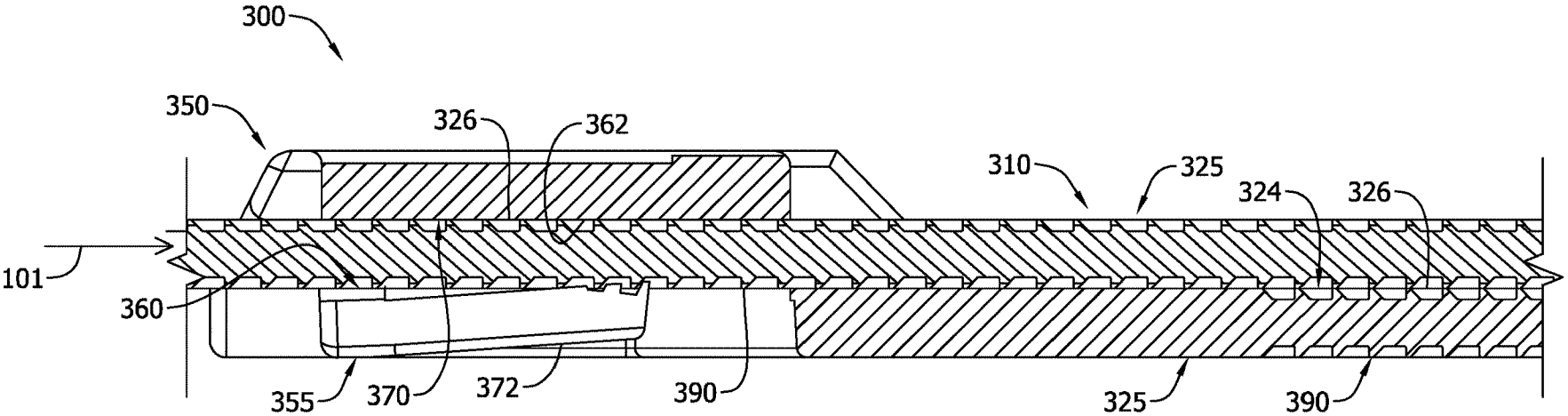
FIG. 11 illustrates a cross-sectional view of the in-line cable bundling system of FIG. 10 with the strap inserted in the insertion channel of the body.

FIGS. 10 and 11 illustrate cross-sectional views of an in-line cable bundling system 300 in accordance with another embodiment of the present disclosure. The in-line cable bundling system 300 of FIGS. 10 and 11 operates substantially the same as the in-line cable bundling systems 200 previously shown and described. The in-line cable bundling system 300 includes a strap 310 and a plurality of strap engagement members 326 similar to the strap210, and the body 350 includes at least one body engagement member 362 and at least one biasing member 372 similar to the body 250 previously described. As shown specifically relative to in-line cable bundling system 200, in cable bundling system 300, the body 350 and the strap 310 are not substantially coplanar.

The plurality of strap engagement members 326 are disposed on a top surface 324 of the strap 310. The top surface 324 of the strap 310 has the same orientation as the top surface 224 of the strap 210 of FIGS. 8 and 9. Therefore, the plurality of strap engagement members 326 are disposed on the same surface relative to the plurality of strap engagement members 226 of FIGS. 8 and 9, and the plurality of strap engagement members 326 have the same orientation as the plurality of strap engagement members 226 of FIGS. 8 and 9.

The at least one body engagement member 362 is disposed on a second channel wall 370 of the body 350 and the at least one biasing member 372 is disposed on a first channel wall 360 of the body 350. The at least one biasing member 372 comprises a barbed flexure 374 having a first end 376 integral to first channel wall 360 of the body 350 and a cantilevered second end 378 extending from the first end 376. The first end 376 is positioned within the insertion channel 352 and adjacent to the first end 354 of the body 350. The cantilevered second end 378 is located within the insertion channel 352 and extends from the first end 376 in the direction of insertion 101 towards the second end 356. The at least one biasing member 372 further includes at least one biasing engagement member 380 having a leading edge 382 and a holding edge 384.

The strap 310 further includes a plurality of second strap engagement members 390 disposed on the bottom surface 325 of the strap 310, and opposite the plurality located along top surface 324. The strap engagement members 326 engage with the at least one body engagement member 362. The plurality of second strap engagement members 390 are configured to engage with the at least one biasing engagement member 380 upon insertion of the strap 310 in the direction of insertion 101.

In operation, the strap 310 is advanced in the direction of insertion 101 through the openings (previously described above) in body 350 until an object bounded by the strap 310 is cinched to a desired torque or holding force, or until the strap can no longer be advanced in the direction of insertion 101. Subsequently advancing the strap 310 in the second direction opposite the direction of insertion 101 causes the plurality of strap engagement members 326 and the plurality of engagement members 390 disposed on the bottom surface 325 of the strap 310 to respectively engage with the at least one body engagement member 362 and the at least one biasing engagement member 380 of the least one biasing member 372 respectively, preventing the strap 310 from further advancing in the opposite direction, and non-removably locking the strap 310 to the body 350 and defining a locked state where loosening displacement of the strap 310 is impeded.

Figure 12:
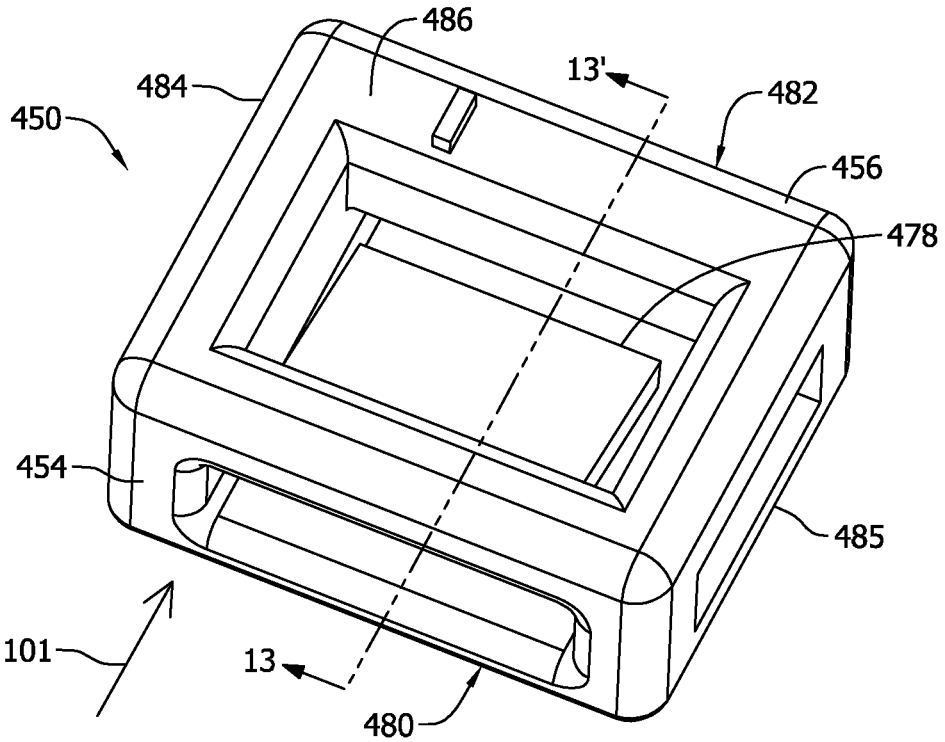
FIG. 12 is a perspective view of a body of an in-line cable bundling system in accordance with a fourth embodiment of the present disclosure.
Figure 13:
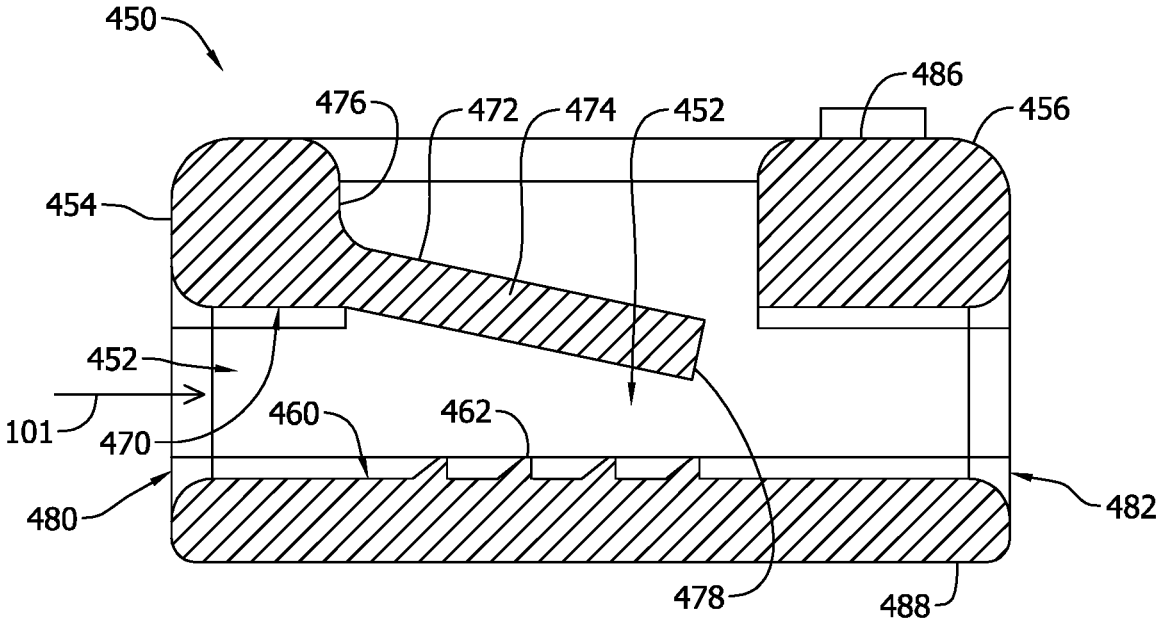
FIG. 13 illustrates cross-sectional view of body of FIG. 12 taken along line 13-13'.

FIGS. 12 and 13 illustrate a body 450 of an in-line cable bundling system in accordance with another embodiment of the present disclosure. The body 450 may be made integral with strap members 110 previously described. The strap may be made integral with the body at bottom side 48G. 12 is a perspective view of the body 450 and FIG. 13 is a cross-sectional view of the body 450 taken along line 13-13'. The body 450 of FIGS. 13 and 14 operates substantially the same as the body 150 of the in-line cable bundling system 100 of FIGS. 1-7. The body 450 includes at least one body engagement member 462 and a biasing member 472 similar to the body 150 of FIGS. 1-7. Body 450 includes leading side 454 with leading opening 480, trailing side 456 with trailing opening 482, lateral sides 484, 485 and top side 486 and bottom 488. The top, bottom and lateral sides extend between the leading and trailing sides 454 and 456. The top, bottom and sides define insertion channel 452.

The at least one body engagement member 462' and a biasing member 472 have the same orientation as the body 150 such that the at least one body engagement member 462 is disposed on a first channel wall 460 and the biasing member 472 is disposed on a second channel wall 370, and extends into the insertion channel 452.

Unlike the body 150 of FIGS. 1-7, the body 450 has a single biasing member 472 which operates in the same manner as the at least one biasing member 172. In particular, the single biasing member 472 comprises a barbed flexure 474 having a first end 476 integral to the second channel wall 470 and a cantilevered second end 478 extending from the first end 476. The cantilevered second end 478 is positioned within the insertion channel 452 and extends from the first end 476 in the direction of insertion 101 towards the second end 456, with the second end of the member terminating proximate engagement members 462. In use the strap is inserted through openings 480 and 482, and as the strap is passed through the insertion channel, strap engagement members 126 engage body engagement members 462, producing a ratchet-like mechanism as previously described in conjunction with other in-line cable ties 100, 200, 300. The biasing member 472 contacts the strap 110 urging the strap towards bottom side 488, to maintain the engagement members in engagement and impeding displacement of the strap in a direction opposite direction 101.

Figure 14:
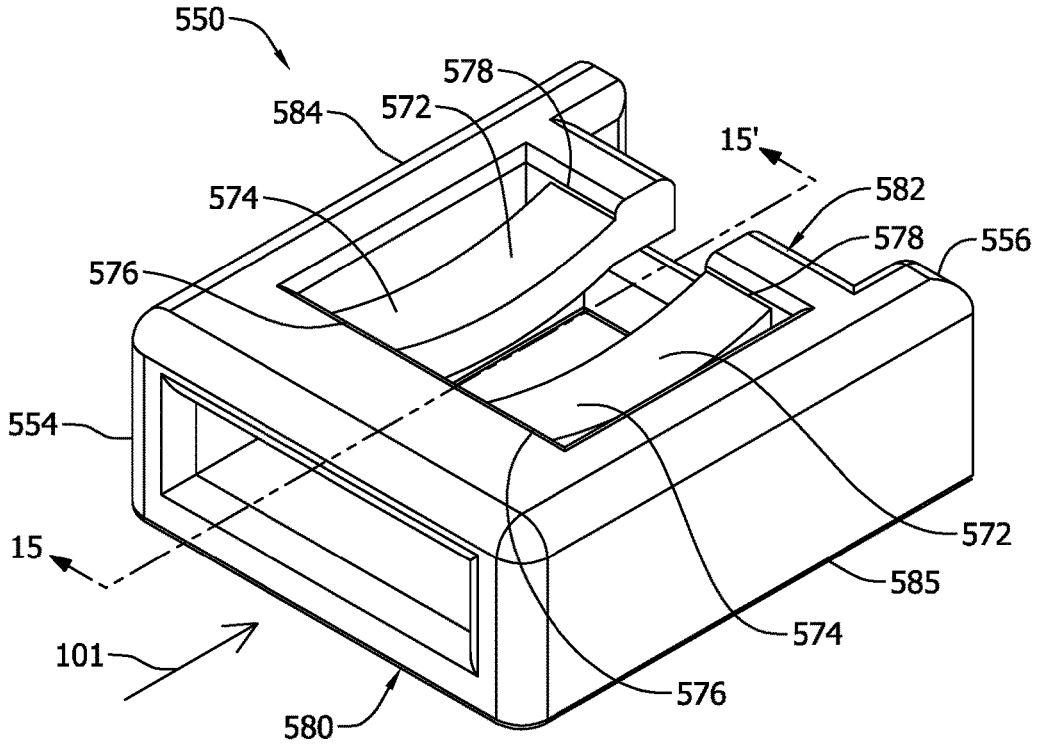
FIG. 14 is a perspective view of a body of an in-line cable bundling system in accordance with a fifth embodiment of the present disclosure; and, FIG. 15 illustrates cross-sectional view of the body of FIG. 14 taken along line 15-15'.
Figure 15:
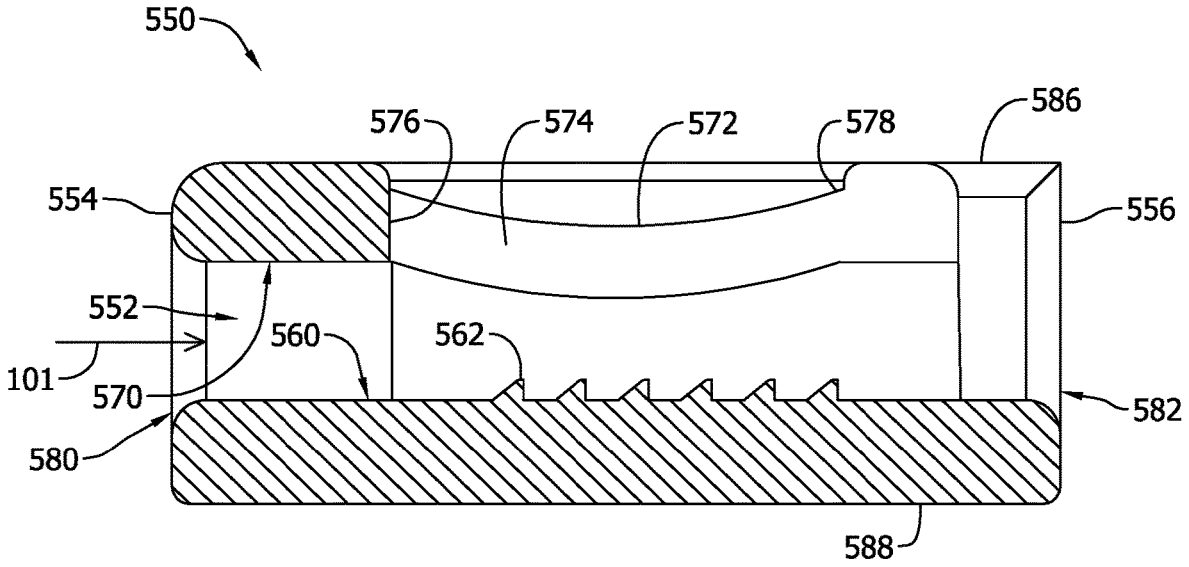

FIGS. 14 and 15 illustrate a body 550 of an in-line cable bundling system 500 in accordance with another embodiment of the present disclosure. The body may be used in combination with strap 110, previously described. FIG. 13 is a perspective view of the body 550 and FIG. 14 is a cross-sectional view of the body 550 taken along line 15-15'. The body 550 of FIGS. 13 and 14 operates substantially the same as the body 150 of the in-line cable bundling system 100 of FIGS. 1-7. The body 550 includes at least one body engagement member 462 similar to the body 150 of FIGS. 1-7 and a plurality of leaf biasing members 572. Body 550 includes leading side 554 with leading opening 580, trailing side 556 with trailing opening 582, lateral sides 584, 585 and top side 586 and bottom 588. The top, bottom and lateral sides extend between the leading and trailing sides 554 and 556. The top, bottom and sides define insertion channel 552.

The at least one body engagement member 462 and the plurality of leaf biasing members 572 have the same orientation as the body 150 of FIGS. 1-7 such that the at least one body engagement member 562 is disposed on a first channel wall 560 and the plurality of leaf biasing members 572 is disposed on a second channel wall 570.

Unlike the body 150 of FIGS. 1-7, the body 550 has a plurality of arcuate-shaped leaf biasing members 572 which operates in the same manner as the at least one biasing member 172 of FIGS. 1-7. In particular, the plurality of leaf biasing members 572 comprises a leaf flexure 574 having a first end 576 and second end 578 integral to the second channel wall 570. The leaf flexure 574 is oriented within the insertion channel 552 and extends from the first end 576 in the direction of insertion 101 towards the second end 578. In use the strap 110 is inserted through openings 580 and 582, and as the strap is passed through the insertion channel, strap engagement members 126 engage body engagement members 562, producing a ratchet-like mechanism as previously described in conjunction with other in-line cable ties 100, 200, 300. The biasing members 572 contact the strap 110 urging the strap towards bottom side 588, to maintain the engagement members in engagement and impeding displacement of the strap in a direction opposite direction 101.

Other variations to the disclosed embodiments can be understood and effected by those skilled in the art in practicing the claimed invention, from the study of the drawings, the disclosure, and the appended claims. In the claims the word "comprising" does not exclude other elements or steps and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An in-line object bundling system comprising:

a body having an insertion channel extending through the body, the channel including a first channel wall and a second channel wall opposite the first channel wall;

at least one engagement member disposed on the first channel wall;

at least one biasing member disposed on the second channel wall; and a strap extending from the body, the strap having a first strap surface and a second strap surface, the second strap surface comprising strap engagement members, the strap being adapted to be advanced through the insertion channel in a direction of insertion, wherein;

the strap extends from the body in a direction parallel to the direction of insertion, while the strap is inserted in the insertion channel, the at least one biasing member continuously applies a biasing force against the first strap surface and as a result of the biasing force against the first strap surface, the at least one biasing member urges the strap engagement members into engagement with-the at least one engagement member on the first channel wall, and the second strap surface is parallel to one of the first channel wall and the second channel wall.

2. The in-line object bundling system of claim 1, wherein the at least one biasing member comprises a barbed flexure having a first end integral to the second channel wall and a cantilevered second end, the first end being adjacent to the first face of the body.

3. The in-line object bundling system of claim 2, wherein the barbed flexure is configured to apply a biasing force against the first strap surface.

4. The in-line object bundling system of claim 2, wherein the barbed flexure is configured to apply a biasing force against the first strap surface such that the strap engagement members are urged into engagement with the at least one engagement member on the first channel wall upon the strap being advanced in a direction opposite the insertion direction.

5. The in-line object bundling system of claim 3, wherein the at least one engagement member comprises at least one holding edge.

6. The in-line object bundling system of claim 5, wherein the strap includes a plurality of corresponding engagement members, each of the corresponding engagement members comprising a leading edge and a holding edge.

7. The in-line object bundling of claim 6, wherein the holding edge of the strap engages the holding edge of the at least one engagement member upon advancement of the strap in a direction opposite the direction of insertion.

8. The in-line object bundling system of claim 2, wherein the at least one biasing member comprises a single barbed flexure.

9. The in-line object bundling system of claim 2, wherein the at least one biasing member comprises two barbed flexures.

10. The in-line object bundling system of claim 1, wherein the at least one biasing member comprises a leaf-spring flexure having a first end integral to the second channel wall and a second end integral to the second channel wall.

11. The in-line object bundling system of claim 10, wherein the leaf-spring flexure is configured to apply a biasing force against the strap such that the strap is urged against the first channel wall.

12. The in-line object bundling system of claim 10, wherein the leaf-spring flexure is configured to apply a biasing force against the strap such that the strap is urged against the first channel wall upon the strap being advanced in a direction opposite the insertion direction and in the insertion direction.

13. The in-line object bundling system of claim 10, wherein the at least one biasing member comprises a single leaf-spring flexure having a first end integral to the second channel wall and a second end integral to the channel wall.

14. The in-line object bundling system of claim 10, wherein the at least one biasing member comprises two leaf-spring flexures each having a first end integral to the second channel wall and a second end integral to the channel wall.

15. The in-line object bundling system of claim 1, wherein the second surface of the body and the first channel wall define a thickness, wherein the strap extends from the thickness.

16. The in-line object bundling system of claim 1, wherein the second surface of the body and the second channel wall define a thickness, wherein the strap extends from the thickness.

17. An in-line object bundling system comprising:

a body having an insertion channel extending through the body, the channel including a first channel wall and a second channel wall opposite the first channel wall;

at least one engagement member disposed on the first channel wall;

at least one biasing member disposed on the second channel wall; and a strap extending from the body, the strap having a first strap surface and a second strap surface, the second strap surface comprising strap engagement members, the strap being adapted to be advanced through the insertion channel in a direction of insertion, wherein:

the strap extends from the body in a direction parallel to the direction of insertion, while the strap is inserted in the insertion channel, the at least one biasing member applies a biasing force against the first strap surface as the strap is inserted in the insertion channel and as a result of the biasing force against the first strap surface, the at least one biasing member urges the strap engagement members into engagement with the at least one engagement member on the first channel wall such that the strap engagement members are maintained in engagement with the at least one body engagement member, and the second strap surface is parallel to one of the first channel wall and the second channel wall.

18. The in-line object bundling system of claim 17, wherein the at least one biasing member comprises a barbed flexure having a first end integral to the second channel wall and a cantilevered second end, the first end being adjacent to the first face of the body.

19. The in-line object bundling system of claim 18, wherein the barbed flexure is configured to apply a biasing force against the first strap surface such that the strap engagement members are urged into engagement with the at least one engagement member on the first channel wall upon the strap being advanced in a direction opposite the insertion direction.

20. The in-line object bundling system of claim 17, wherein the at least one biasing member comprises a leaf-spring flexure having a first end integral to the second channel wall and a second end integral to the second channel wall.

* * * * *